US006480611B2

(12) United States Patent
Hashimoto et al.

(10) Patent No.: US 6,480,611 B2
(45) Date of Patent: Nov. 12, 2002

(54) HEADPHONE HAVING A CORD REEL

(75) Inventors: Junichi Hashimoto, Neyagawa (JP); Eiichi Takakura, Neyagawa (JP)

(73) Assignee: Matsushita Electric Industrial Co., Ltd., Kodama (JP)

( * ) Notice: Subject to any disclaimer, the term of this patent is extended or adjusted under 35 U.S.C. 154(b) by 0 days.

(21) Appl. No.: 09/891,127

(22) Filed: Jun. 26, 2001

(65) Prior Publication Data

US 2002/0012440 A1 Jan. 31, 2002

(30) Foreign Application Priority Data

Jun. 26, 2000 (JP) ..... 2000-190907

(51) Int. Cl.[7] ..... H04R 25/00
(52) U.S. Cl. ..... 381/371; 381/384; 439/501
(58) Field of Search ..... 381/371, 370, 381/384; 439/501, 4, 12, 13, 18, 20, 22, 24, 27, 172; 455/351, 90, 89, 575, 569; 379/438, 430

(56) References Cited

U.S. PATENT DOCUMENTS 3,798,389 A * 3/1974 Tokizaki
5,339,461 A * 8/1994 Luphow
5,422,957 A * 6/1995 Cummins
5,832,098 A * 11/1998 Chen
6,402,546 B1 * 6/2002 Groves et al.

FOREIGN PATENT DOCUMENTS

JP 253477 * 9/2000
JP 10385 * 1/2002

* cited by examiner

*Primary Examiner*—Sinh Tran
(74) *Attorney, Agent, or Firm*—Wenderoth, Lind & Ponack, L.L.P.

(57) ABSTRACT

A headphone includes a housing assembly having an electroacoustic transducer accommodated therein and an insertion hole defined therein. A winding mechanism is accommodated in the housing assembly for winding an input cord into the housing assembly. The winding mechanism includes a cord reel biased to wind the input cord therearound and an engagement member pivotally mounted in the housing assembly. When an input plug secured to one end of the input cord is inserted into the insertion hole, the input plug rotates the engagement member in a first direction, which in turn allows the cord reel to wind the input cord therearound. When the input plug is removed from the insertion hole, the engagement member rotates in a second direction counter to the first direction, allowing the input cord to be drawn out of the housing assembly and preventing the cord reel from winding the input cord therearound.

3 Claims, 7 Drawing Sheets

HEADPHONE HAVING A CORD REEL

BACKGROUND OF THE INVENTION

1. Field of the Invention

The present invention relates generally to a headphone for use with portable acoustic appliances or the like and, in particular but not exclusively, to a headphone having a cord reel for winding an input cord within a housing.

2. Description of the Related Art

Recently, headphones are increasingly utilized with the development of portable acoustic appliances. When a user carries a headphone with him or her, attention must be paid to an input cord.

Some of the conventional radios have an earphone and accommodate a cord reel for winding an input cord for the earphone therearound. The cord reel has a spring for biasing the input cord in the direction in which the input cord is wound in a housing, and also has an engaging means that engages with the input cord to bring it to a stop at any desired position during the winding thereof around the cord reel.

When the use of the earphone is desired, the input cord is drawn out by a desired length against the engaging means. On the contrary, when the input cord is stored within the housing, depressing a button for releasing the engaging means causes the input cord to be introduced into the housing by the force of the spring.

Such an arrangement cannot be employed in a housing of a headphone without any modification. The reason for this is that under the condition in which the user wears the headphone on his or her ears, if the engaging means is released in an attempt to introduce the input cord into the housing, there is a possibility that an input plug secured to a distal end of the input cord may impinge on his or her face or eye because of its momentum.

In order to prevent this, the inventors of this application have proposed a headphone having a safety mechanism in which the engagement by the engaging means cannot be released until the user first takes off the headphone from his or her head and then folds down a headband attached thereto. However, headphones of the ear-hanging type which are to be hung on the ears without using the headband are frequently used nowadays, and the aforementioned safety mechanism cannot be applied thereto.

SUMMARY OF THE INVENTION

The present invention has been developed to overcome the above-described disadvantages.

It is accordingly an objective of the present invention to provide an improved headphone having a cord reel that is capable of preventing an input plug secured to a distal end of the input cord from impinging on the user's face or eye. The present invention is applicable to the headphones of the ear-hanging type.

In accomplishing the above and other objectives, the headphone according to the present invention includes a housing assembly having an electroacoustic transducer accommodated therein and an insertion hole defined therein, an input cord having an input plug secured to one end thereof, the input cord being connected at the other end thereof to the electroacoustic transducer, and a winding mechanism accommodated in the housing assembly for winding the input cord within the housing assembly. The winding mechanism includes a cord reel biased to wind the input cord therearound and an engagement member pivotally mounted in the housing assembly.

When the input plug is inserted into the insertion hole, the input plug rotates the engagement member in a first direction, which in turn allows the cord reel to wind the input cord therearound. On the other hand, when the input plug is removed from the insertion hole, the engagement member rotates in a second direction counter to the first direction, allowing the input cord to be drawn out of the housing assembly and preventing the cord reel from winding the input cord therearound.

This construction facilitates the winding of the input cord, and when the input plug is inserted into the insertion hole of the housing assembly in an attempt to wind the input cord around the cord reel, the input plug causes the engagement member to release the locking of the cord reel. As a result, the input cord is wound around the cord reel with the input plug retained in the insertion hole, making it possible to prevent the input plug from impinging on the user's body.

Advantageously, the winding mechanism includes a spring member secured to the housing assembly for holding the input plug when the input plug is inserted into the insertion hole. This construction further enhances the safety of the headphone.

Conveniently, the engagement member has a locking piece and a lock releasing piece, both integrally formed therewith, and the cord reel has an outer periphery defining a plurality of notches or protrusions. The input plug is brought into contact with the lock releasing piece when the input plug is inserted into the insertion hole, while the locking piece engages with an edge of one of the plurality of notches or protrusions when the input plug is removed from the insertion hole.

BRIEF DESCRIPTION OF THE DRAWINGS

The above and other objectives and features of the present invention will become more apparent from the following description of a preferred embodiment thereof with reference to the accompanying drawings, throughout which like parts are designated by like reference numerals, and wherein.

DETAILED DESCRIPTION OF THE PREFERRED EMBODIMENTS

This application is based on an application No. 2000-190907 filed Jun. 26, 2000 in Japan, the content of which is herein expressly incorporated by reference in its entirety.

Figure 1:
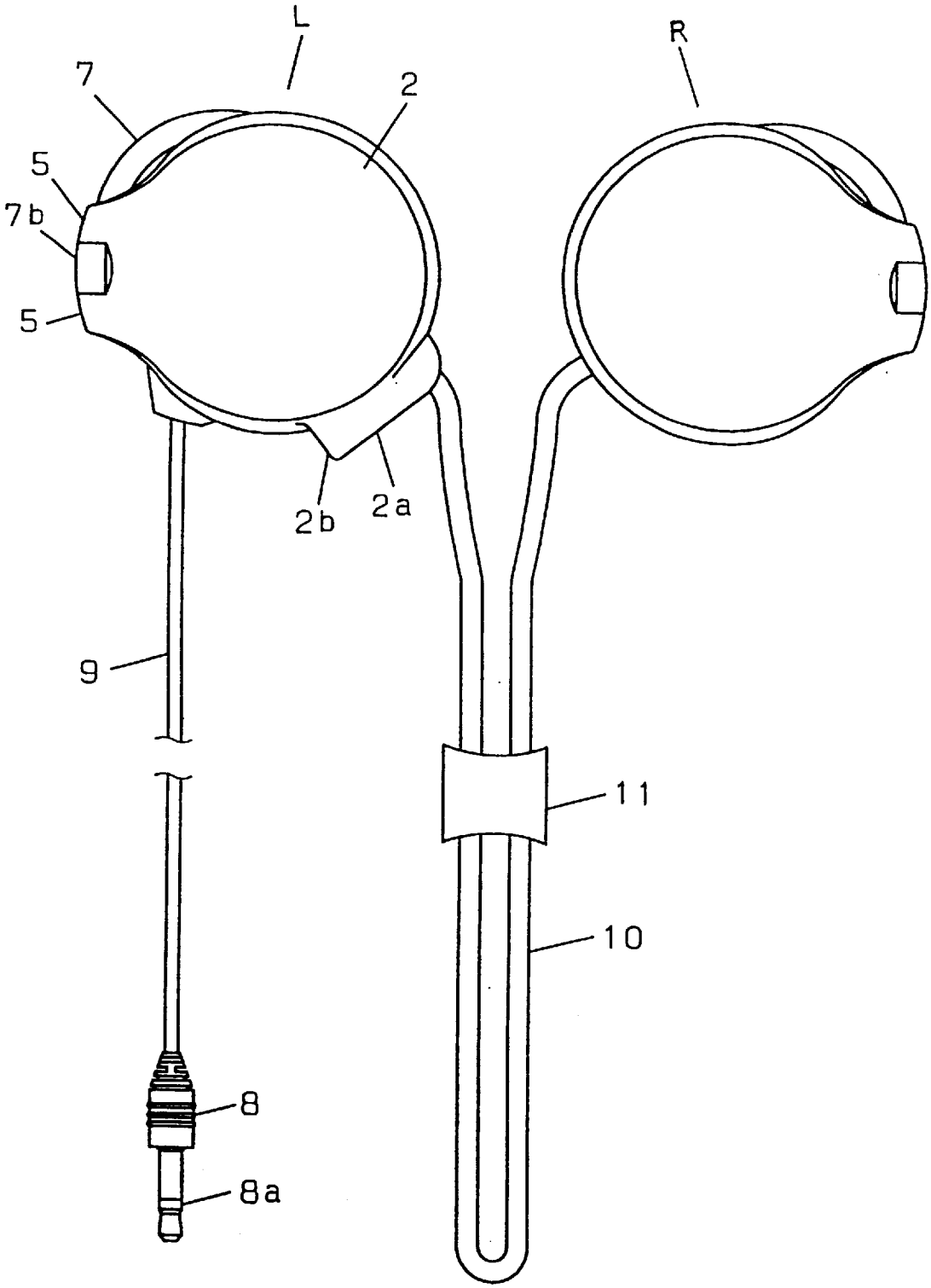
FIG. 1 is a front view of a headphone according to the present invention.
Figure 2:
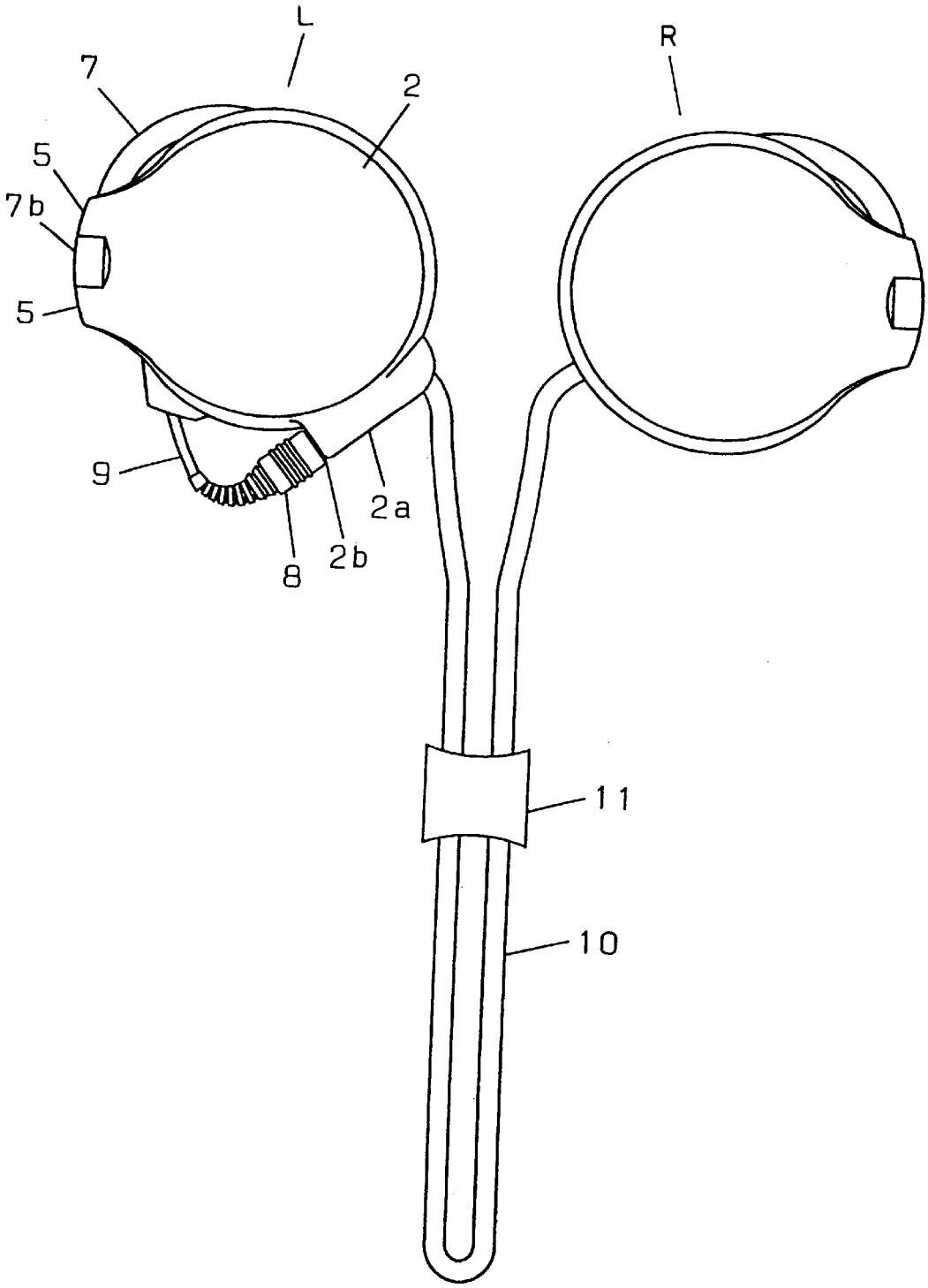
FIG. 2 is a view similar to FIG. 1, but particularly depicting the condition in which the winding of an input cord has been completed.

Referring now to the drawings, there is shown in FIGS. 1 and 2 a headphone embodying the present invention. The headphone shown therein includes a first housing assembly L for the left ear and a second housing assembly R for the right ear, both of which are made of plastic or a metal.

Figure 5A:
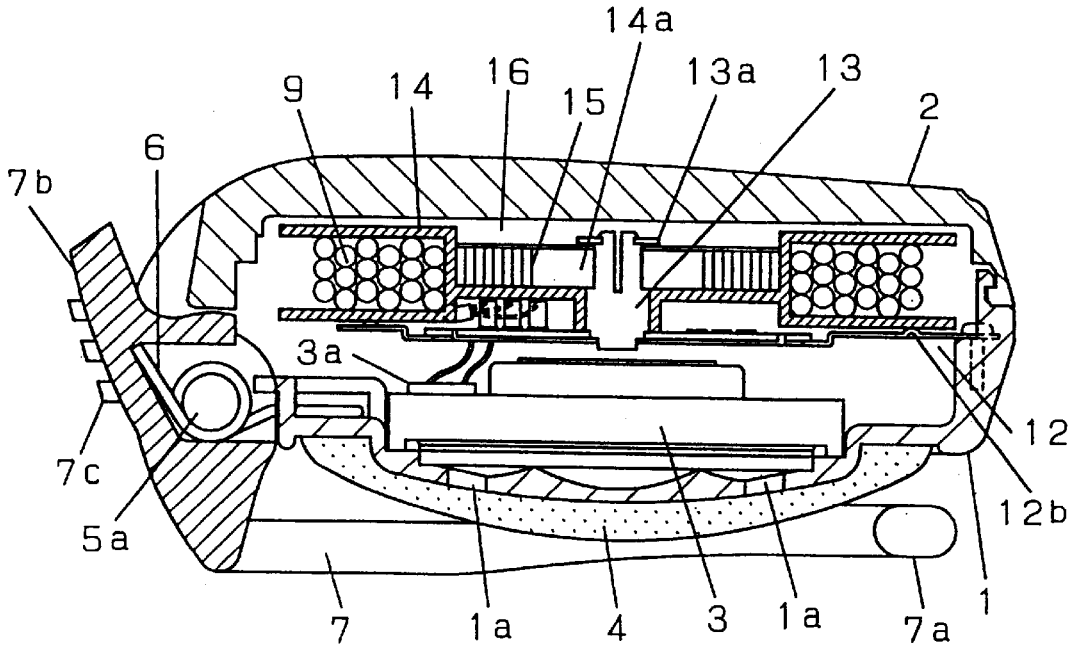
FIG. 5A is a partial sectional view of the housing assembly having a winding mechanism accommodated therein.

As best shown in FIG. 5A, the first housing assembly L includes a housing made up of a front housing 1 and a rear housing 2. The front housing 1 includes a speaker unit (a first electroacoustic transducer) 3 mounted therein and a plurality of holes 1*a* defined therein at a location confronting a front face of the speaker unit 3. The speaker unit 3 emits a sound pressure through the holes 1*c*. Because the front face of the front housing 1 is brought into contact with the user's ear, it is covered with an ear pad 4 made of a material such, for example, as cloth, expanded polyurethane having a large number of successively formed air bubbles, or the like, which is gentle with skin while allowing sound to pass therethrough.

Figure 3:
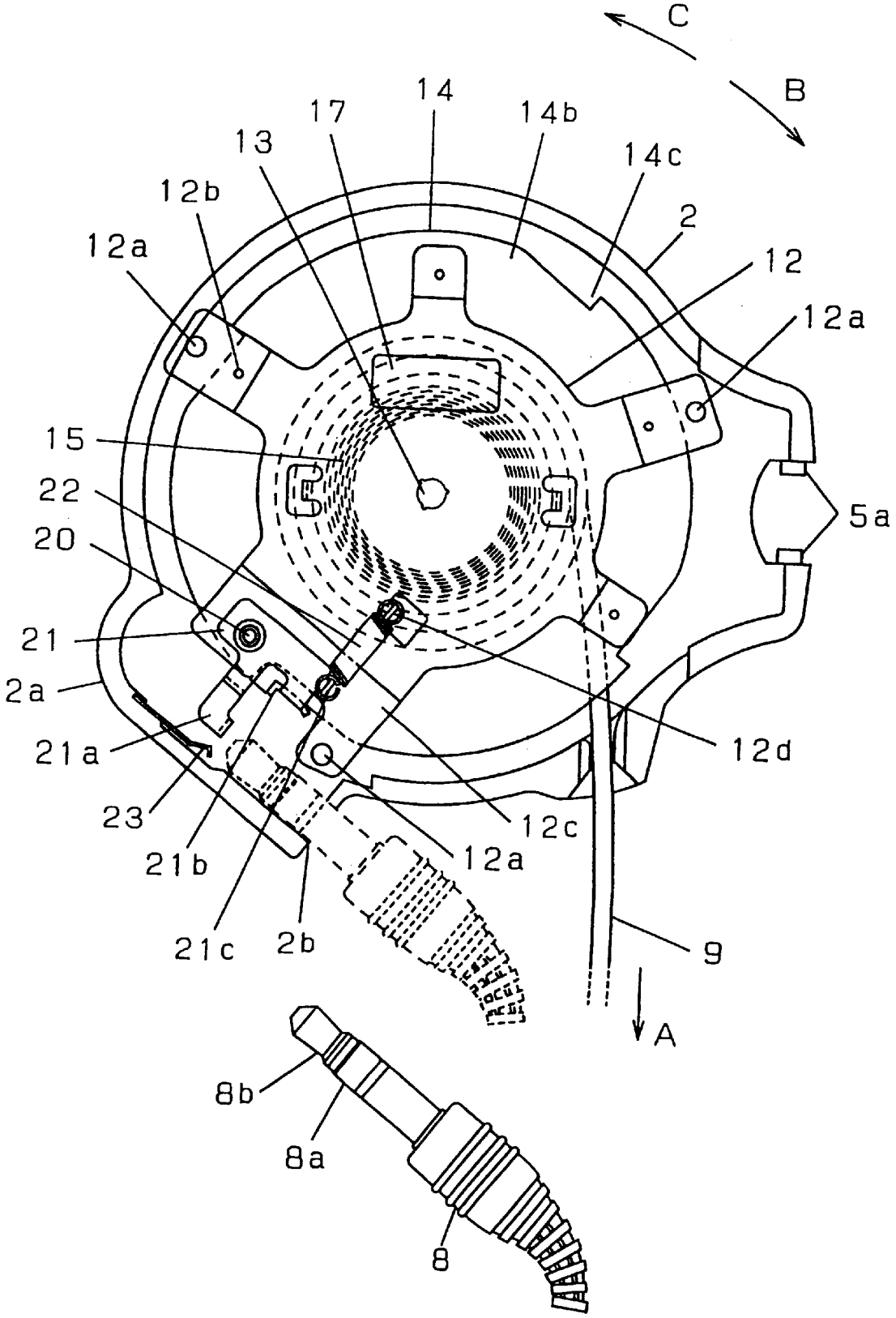
FIG. 3 is a front view of one of two housing assemblies with a front housing removed therefrom.
Figure 6:
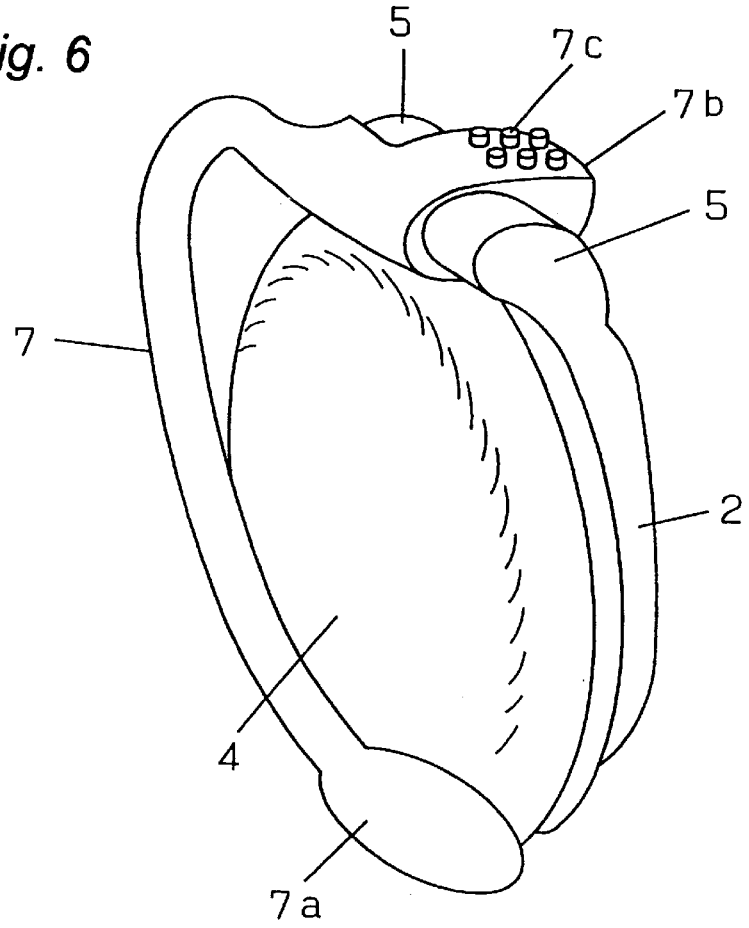
FIG. 6 is a perspective view of the housing assembly of FIG. 5A.
Figure 7:
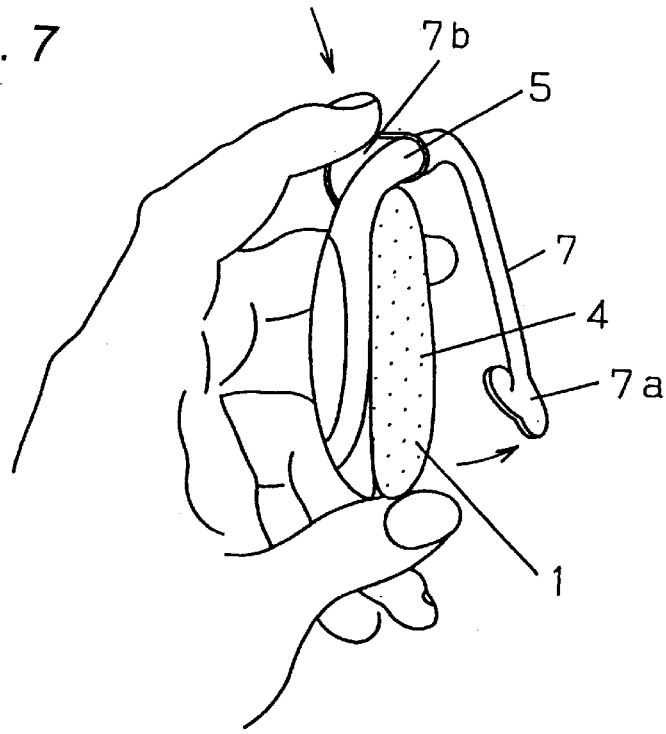
FIG. 7 is a perspective view of the housing assembly of FIG. 5A when fitted on an ear of the user.

The rear housing 2 has two shaft supports 5 integrally formed therewith so as to extend laterally outwardly therefrom. As shown in FIG. 3, the two shaft supports 5 have respective shafts 5*a* integrally formed therewith so as to extend inwardly therefrom. Each of the shafts 5*a* is loosely inserted into a through-hole defined in an ear clamp 7 to pivotally support the ear clamp 7 about it. A spring 6 engages with the shafts 5*a* and biases a distal end 7*a* of the ear clamp 7 towards the front housing 1. As shown in FIG. 6, the ear clamp 7 has a pressure portion 7*b* formed on a proximal end thereof, i.e., the opposite side of the distal end 7*a* thereof with respect to the through-holes, and also has a non-slip portion 7*c* formed on the pressure portion 7*b*. Depressing the pressure portion 7*b* causes the distal end 7*a* of the ear clamp 7 to move away from the front housing 1, as shown in FIG. 7.

The headphone is normally fitted on both ears of the user. Accordingly, as shown in FIG. 1, an input cord 9 having an input plug 8 secured to one end thereof is connected at the other end thereof to the speaker unit 3 in one of the housing assemblies (the first housing assembly L in the illustrated embodiment). The input plug 8 has a connection terminal 8*a* that is to be connected to a portable acoustic appliance or the like. A bridging cord 10, through which some of a plurality of lead wires that are connected to a speaker unit in the second housing assembly R run, extends outwardly from the first housing assembly L, passes through a through-hole defined in a slider 11, returns to the slider 11 in the form of a figure "U", passes through another through-hole defined in the slider 11, and is finally introduced into the second housing assembly R. The two through-holes of the slider 11 are so formed as to be substantially parallel to each other and so sized as to allow the slider 11 to freely slide along the bridging cord 10. The slider 11 acts to change the length of the bridging cord 10 between the first housing assembly L and the slider 11 and between the second housing assembly R and the slider 11.

Figure 4:
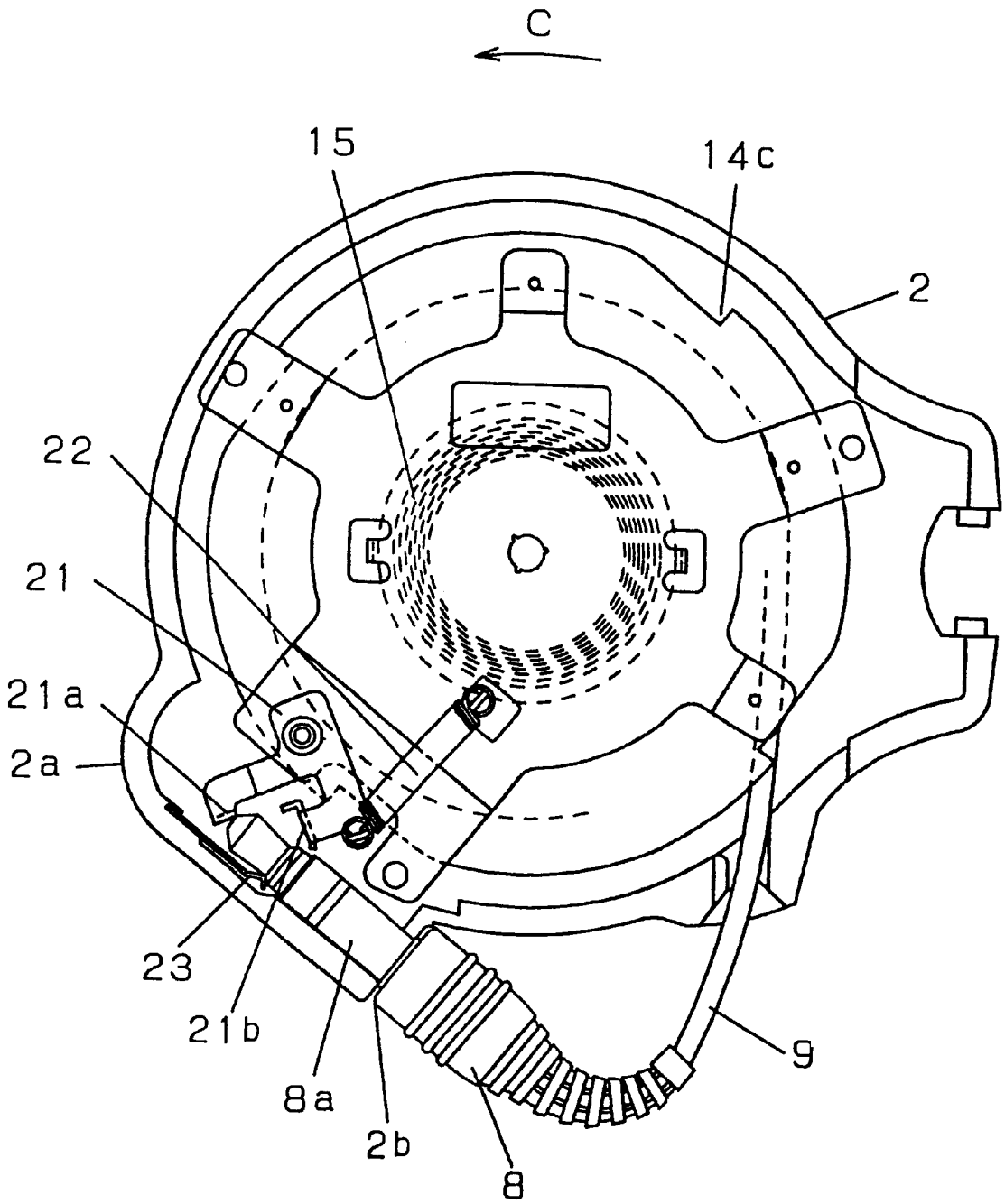
FIG. 4 is a view similar to FIG. 3, but depicting the condition in which the locking of a cord reel has been released.

As shown in FIGS. 3, 4 and 5A, the first housing assembly L connected to the input cord 9 accommodates a base plate 12 that is secured to the front housing 1 by a plurality of (for example, three) screws threaded into respective holes 12*a*. The base plate 12 has a center hole defined therein to which one end of a shaft 13 is secured by caulking, and a cord reel 14 is rotatably mounted on the shaft 13. The cord reel 14 has a recess 14*a* defined therein, in which a spiral spring 15 is accommodated having opposite ends secured to the shaft 13 and the cord reel 14, respectively. The spiral spring 15 is held in position by a spring holder 16, which is in turn held in position on the other end of the shaft 13 by an E-shaped stopper 13*a*. The base plate 12 has a plurality of (for example, three) projections 12*b* formed therewith on the side confronting the cord reel 14. The plurality of projections 12*b* are held in point contact with the cord reel 14 to reduce friction between them during rotation of the cord reel 14.

Figure 5B:
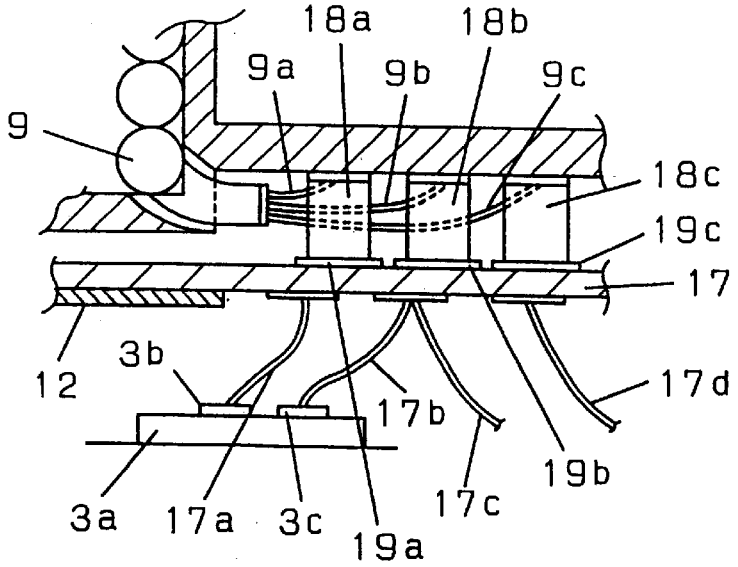
FIG. 5B is a sectional view, on an enlarged scale, of a portion of the housing assembly of FIG. 5A.

As best shown in FIG. 5B, the cord reel 14 has three brushes 18*a*, 18*b*, 18*c* secured thereto at regular intervals on the face confronting the base plate 12. The three brushes 18*a*, 18*b*, 18*c* are all made of an elastic metallic plate and electrically connected to an L-channel lead wire 9*a*, a common lead wire 9*b*, and an R-channel lead wire 9*c* of the input cord 9, respectively, at a proximal end of the input cord 9. On the other hand, a terminal substrate 17 is secured to the base plate 12 and has three metallic slip rings 19*a*, 19*b*, 19*c* secured thereto in a concentric fashion, which are in turn held in pressure contact with the brushes 18*a*, 18*b*, 18*c*, respectively. By this construction, even if the cord reel 14 rotates, a sound signal inputted via the input cord 9 is continuously transmitted to the terminal substrate 17 by virtue of sliding movement between the brushes 18*a*, 18*b*, 18*c* and the slip rings 19*a*, 19*b*, 19*c* under pressure contact. The sound signal so transmitted to the terminal substrate 17 is further transmitted to terminals 3*b*, 3*c* of the speaker unit 3 via lead wires 17*a*, 17*b*, respectively. Of the lead wires running through the input cord 9, the common lead wire 9*b* and the R-channel lead wire 9*c* are connected to the second housing assembly R for the right ear via lead wires 17*c*, 17*d*, respectively, which run through the bridging cord 10.

Although in the above-described embodiment the winding mechanism is mounted on the front housing 1, it may be mounted on the rear housing 2.

The cord reel 14 has two flanges, one 14*b* of which has a sawtooth outer periphery defining a plurality of (for example, four) notches 14*c* at regular intervals. As best shown in FIGS. 3 and 4, the base plate 12 has a protruding portion 12*c* integrally formed therewith, to which a shaft 20 is secured. An engagement member 21 is pivotally mounted on the shaft 20. The engagement member 21 has a locking piece 21*b* and a lock releasing piece 21*a*, both integrally formed therewith. The locking piece 21*b* acts to stop the winding of the input cord 9 around the cord reel 14 as occasion demands, while the lock releasing piece 21 a acts to release the locking of the cord reel 14 by the locking piece 21*b*. In FIGS. 3 and 4, the engagement member 21 is biased in the counterclockwise direction by a coil spring 22, opposite ends of which are respectively fixed to a hook 21*c* integrally formed with the engagement member 21 and another hook 12*d* secured to or otherwise integrally formed with the base plate 12. That is, the elastic force of the coil spring 22 acts to move the locking piece 21*b* towards the outer periphery of the flange 14*b*.

The rear housing 2 of the first housing assembly L has a protruding portion 2*a* integrally formed therewith and having an insertion hole 2*b* defined therein, into which the connection terminal 8*a* of the input plug 8 is to be inserted. The connection terminal 8*a* has a small-diameter portion 8*b* adjacent to a free end thereof, with which a spring plate 23 secured to an inner surface of the protruding portion 2*a* is to engage to hold the connection terminal 8*a* within the insertion hole 2*b*.

The headphone of the above-described construction is manipulated in the following manner.

Figure 8:
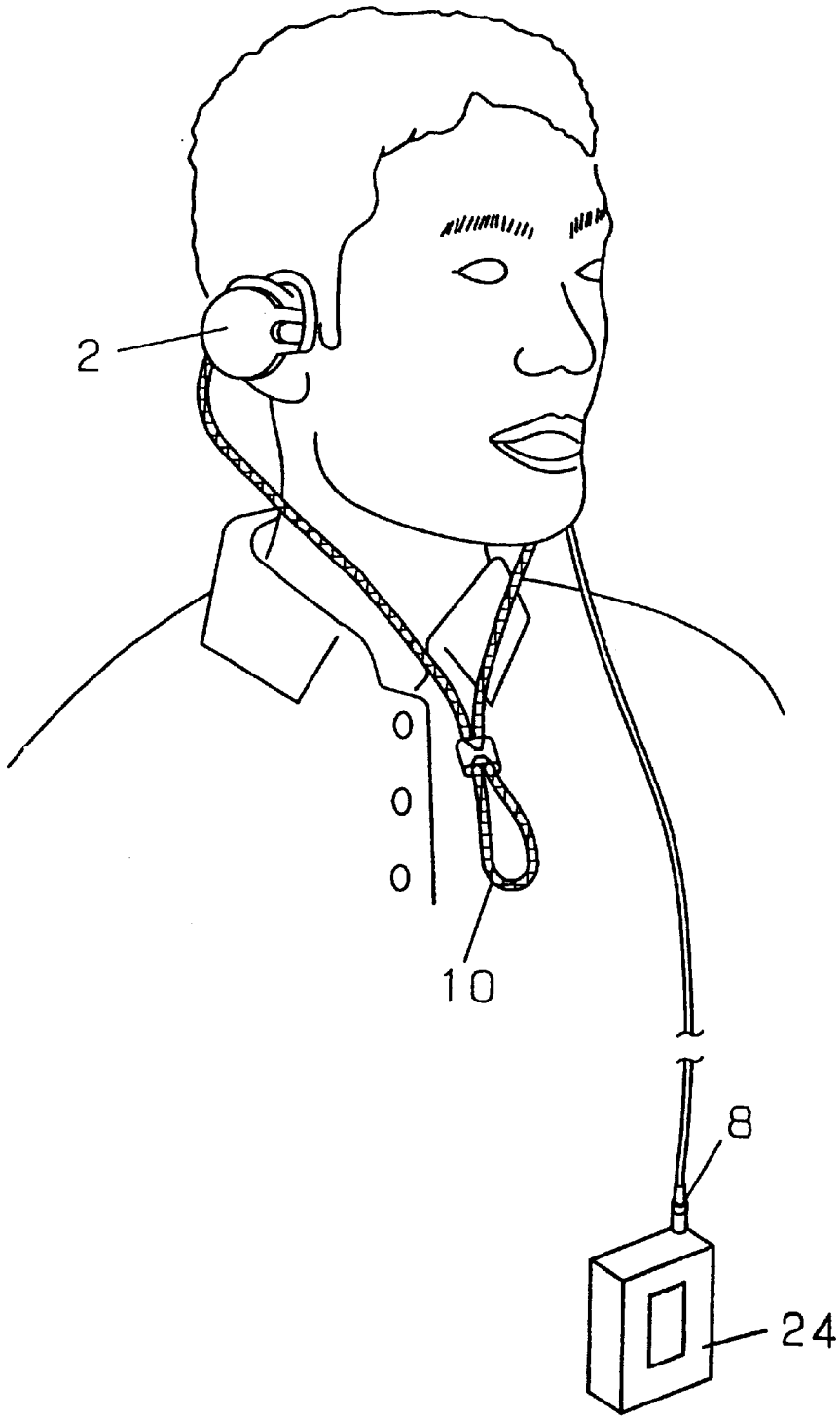
FIG. 8 is a perspective view of the headphone of FIG. 1, when fitted on both ears of the user.

As shown in FIG. 7, when the pressure portion 7*b* of the ear clamp 7 is depressed, the distal end 7*a* of the ear clamp 7 is moved away from the front housing 1. The first housing assembly L is then fitted on the left ear by inserting the ear clamp 7 in between a rear face of the auricle and the head. Thereafter, the second housing assembly R is fitted on the right ear in the same manner. A subsequent upward movement of the slider 11 reduces the slack in the bridging cord 10, as shown in FIG. 8. Then, when the input cord 9 is drawn out in the direction of an arrow A in FIG. 3, the cord reel 14 rotates in the direction of an arrow B. At this moment, because the locking piece 21*b* of the engagement member 21 is biased against the outer periphery of the flange 14*b* by the elastic force of the coil spring 22, the locking piece 21*b* intermittently falls into the notches 14*c* in the flange 14*b*, while allowing rotation of the cord reel 14. When the drawing of the input cord 9 is stopped at a desired length, the restoring force of the spiral spring 15 rotates the cord reel 14 in a direction counter to the direction of the arrow B to some extent. However, when the locking piece 21*b* falls into one of the notches 14*c*, the locking piece 21*b* engages with an edge of the one of the notches 14*c*, thus stopping rotation of the cord reel 14. Thereafter, the connection terminal 8*a* of the input plug 8 is inserted into an output terminal (jack) of a portable acoustic appliance 24.

When the input cord 9 is stored in the cord reel 9 after the use of the acoustic appliance 24, the connection terminal 8*a* of the input plug 8 is first inserted into the insertion hole 2*b*, as shown in FIG. 4. When the connection terminal 8*a* is brought into contact with the lock releasing piece 21*a*, the engagement member 21 is caused to rotate in the clockwise direction against the biasing force of the coil spring 22. Thus, the locking piece 21*b* moves away from the notch 14*c* in the flange 14*b*, allowing the cord reel 14 to rotate freely. As a result, the restoring force of the spiral spring 15 rotates the cord reel 14 in the direction of an arrow C, thereby winding the input cord 9 around the cord reel 14. In this event, because the small-diameter portion 8*b* of the connection terminal 8*a* is held by the spring plate 23, the problem does not arise that the input plug 8 may impinge on the user's face, eye or any other portion of the user's body.

Although in the above-described embodiment the spring plate 23 is provided to hold the connection terminal 8*a* of the input plug 8, it is not always required. With the positional relationship as shown in FIG. 4, no spring plate is necessary, because the tension of the input cord 9 wound around the cord reel 14 does not act in the direction in which the connection terminal 8*a* of the input plug 8 is drawn out of the insertion hole 2*b*.

Furthermore, although the headphone has been described as being fitted on both ears of the user, the present invention is applicable to a headphone for one ear.

Also, the present invention is readily applicable to a headphone with a headband.

Moreover, although in the above-described embodiment the flange 14*b* of the cord reel 14 has been described as having a sawtooth outer periphery, a plurality of notches may be formed in an additional component part separate from the flange 14*b*. In addition, the plurality of notches may be replaced by a plurality of projections protruding radially outwardly from the outer periphery of the flange 14*b*. In this case, the plurality of projections have respective edges with which the locking piece 21*b* engages to lock the cord reel 14.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A headphone comprising:

a housing assembly having an electroacoustic transducer accommodated therein and an insertion hole defined therein;

an input cord having an input plug secured to one end thereof, said input cord being connected at the other end thereof to said electroacoustic transducer; and a winding mechanism accommodated in said housing assembly for winding said input cord in said housing assembly, said winding mechanism comprising:

a cord reel biased to wind said input cord therearound; and an engagement member pivotally mounted in said housing assembly;

wherein when said input plug is inserted into said insertion hole, said input plug rotates said engagement member in a first direction, which in turn allows said cord reel to wind said input cord therearound, and when said input plug is removed from said insertion hole, said engagement member rotates in a second direction counter to the first direction, allowing said input cord to be drawn out of said housing assembly and preventing said cord reel from winding said input cord therearound.

2. The headphone according to claim 1, wherein said winding mechanism comprises a spring member secured to said housing assembly for holding said input plug when said input plug is inserted into said insertion hole.

3. The headphone according to claim 1, wherein said engagement member has a locking piece and a lock releasing piece, both integrally formed therewith, and said cord reel has an outer periphery defining a plurality of notches or protrusions, said input plug being brought into contact with said lock releasing piece when said input plug is inserted into said insertion hole, said locking piece engaging with an edge of one of said plurality of notches or protrusions when said input plug is removed from said insertion hole.

* * * * *